US005966426A

United States Patent [19]

Marra et al.

[11] Patent Number: 5,966,426

[45] Date of Patent: Oct. 12, 1999

[54] X-RAY EXAMINATION APPARATUS INCLUDING AN X-RAY FILTER

[75] Inventors: Johannes Marra; Wilhelmus J. J. Welters, both of Eindhoven, Netherlands

[73] Assignee: U.S. Philips Corporation, New York, N.Y.

[21] Appl. No.: 08/957,992

[22] Filed: Nov. 5, 1997

[30] Foreign Application Priority Data

Dec. 11, 1996 [EP] European Pat. Off. ..... 96203159

[51] Int. Cl.[6] ..... G21K 3/00

[52] U.S. Cl. ..... 378/159; 378/156

[58] Field of Search ..... 378/159, 156

[56] References Cited

U.S. PATENT DOCUMENTS 5,559,853 9/1996 Lenders et al. ..... 378/159

5,625,665 4/1997 Fokkink et al. ..... 378/159

*Primary Examiner*—Craig E. Church

*Attorney, Agent, or Firm*—Dwight H. Renfrew, Jr.

[57] ABSTRACT

An X-ray examination apparatus (1) is provided with an X-ray source (2) and an X-ray detector (5) wherebetween there is arranged an X-ray filter (6) which includes filter elements (7) whose X-ray absorptivity can be adjusted by controlling the quantity of X-ray absorbing liquid (31) in individual filter elements (7). The filter elements (7) are formed by spaces between electrically conductive tracks (9) provided on parallel plates (8). The parallel plates are arranged in a reservoir (31) for the X-ray absorbing liquid. The liquid level in the vicinity of an electrically conductive track is controlled on the basis of an electric voltage applied to the relevant electrically conductive track (9).

20 Claims, 4 Drawing Sheets

X-RAY EXAMINATION APPARATUS INCLUDING AN X-RAY FILTER

BACKGROUND OF THE INVENTION

1. Field of the Invention

The invention relates to an X-ray examination apparatus, including an X-ray source, an X-ray detector for picking up the X-ray image, and an X-ray filter which is arranged between the X-ray source and the X-ray detector, the X-ray absorptivity of the X-ray filter being locally adjustable by control of a local quantity of an X-ray absorbing liquid in the X-ray filter.

2. Description of the Related Art

An X-ray examination apparatus of this kind is known from French Patent Application FR 2 599 886.

The known X-ray apparatus is provided with a filter for limiting the dynamic range of an X-ray image, being the interval between the extremes of the brightness values. An X-ray image is formed on the X-ray detector by arranging an object, for example a patient to be examined, between the X-ray source and the X-ray detector and exposing the object to X-rays emitted by the X-ray source. If no steps are taken, the dynamic range of the X-ray image may become large. On the one hand, for some parts of the object, for example lung tissue, the X-ray transmissivity is high, whereas other parts of the object, such as bone tissue, can hardly be penetrated by X-rays. Lead shutters used to intercept parts of the X-ray beam from the X-ray source so as to shield parts of the object to be examined from the X-rays are imaged with a uniform, very low brightness. Lead shutters are also used to prevent X-rays which fail to pass through the object from reaching the X-ray detector, leading to overexposed areas in the X-ray image. If no further steps are taken, therefore, an X-ray image will be obtained with a very large dynamic range whereas, for example medically relevant information in the X-ray image is contained in brightness variations in a much smaller dynamic range; because it is not very well possible to make small details of low contrast suitably visible in a rendition of such an X-ray image, it is not very suitable for making a diagnosis. Furthermore, problems are encountered when such an X-ray image is picked up by means of an image intensifier pick-up chain. An image intensifier pick-up chain includes an image intensifier tube for converting an incident X-ray image into an optical image and a video camera for deriving an electronic image signal from the optical image. Regions of very high brightness and regions of very low brightness are formed in the optical image from regions of very high brightness and very low brightness, respectively, in the X-ray image. If no further steps are taken, the dynamic range of the optical image could be larger than the range of brightness values that can be handled by the video camera without giving rise to disturbances in the electronic image signal.

In order to limit the dynamic range of the X-ray image, the known X-ray examination apparatus includes a filter with filter elements provided with a bundle of parallel capillary tubes, each of which is connected, via a valve, to a reservoir containing an X-ray absorbing liquid which suitably wets the inner walls of the capillary tubes. In order to fill a capillary tube with the X-ray absorbing liquid, the valve of the relevant capillary tube is opened after which the capillary tube is filled with the X-ray absorbing liquid by the capillary effect. Such a filled capillary tube has a high X-ray absorptivity for X-rays which pass therethrough in a direction approximately parallel to its longitudinal axis. The valves are controlled so as to ensure that the quantity of X-ray absorbing liquid in the capillary tubes is adjusted such that filter elements in parts of the X-ray beam which pass through parts of the object of low X-ray absorption are adjusted to a high X-ray absorptivity and that filter elements in parts of the X-ray beam which pass through parts of the object of high X-ray absorption, or are intercepted by a lead shutter, are adjusted to a low X-ray absorptivity.

In order to change the adjustment of the filter of the known X-ray examination apparatus it is necessary to empty the filled capillary tubes first. Therefore, use is made of a paramagnetic X-ray absorbing liquid which is removed from the capillary tubes by application of a magnetic field. After all capillary tubes have been drained, the filter is adjusted again by deactivation of the magnetic field, followed by the opening of the valves of capillary tubes which must be filled with the X-ray absorbing liquid so as to raise their X-ray absorptivity to a high value according to the new filter adjustment.

It is a drawback of the known filter that it is not very well possible to change the adjustment of the filter within a very short period of time, say one second. Therefore, the known X-ray apparatus is not suitable for forming successive X-ray images at a high image rate, where the adjustment of the filter is changed between the formation of successive X-ray images. Because it is necessary to drain all capillary tubes before the filter elements can be adjusted to new X-ray absorptivities and because the X-ray absorbing liquid suitably wets the inner wall of the capillary tube so that draining requires a rather long period of time, amounting to several seconds or even tens of seconds, switching over the known filter requires a comparatively long period of time. Moreover, it is not very well possible to drain the capillary tubes completely by application of the magnetic field, because a layer of X-ray absorbing liquid will remain on the inner walls of the capillary tubes.

It is a further drawback of the known filter that the construction involving separate mechanical valves for each of the capillary tubes is rather complex.

SUMMARY OF THE INVENTION

It is an object of the invention to provide an X-ray examination apparatus which includes a filter whose adjustment can be changed within a short period of time.

This object is achieved by means of an X-ray examination apparatus according to the invention which is characterized in that the X-ray filter is provided with substantially parallel plates with electrically conductive portions, and that a quantity of X-ray absorbing liquid between respective parallel plates can be controlled.

In order to form an X-ray image, the X-ray source emits an X-ray beam which irradiates the object to be examined. The X-ray image is formed on the X-ray detector. The X-ray filter serves for local and dynamic influencing of the intensity of the X-rays reaching the X-ray detector.

The gaps between the parallel plates communicate with a reservoir containing an X-ray absorbing liquid. The X-ray examination apparatus includes an adjusting circuit for applying electric voltages to individual electrically conductive portions, the local quantity of X-ray absorbing liquid in the X-ray filter being controllable on the basis of said electric voltages. In this context an electric voltage is to be understood to mean the electric potential difference between the relevant electrically conductive portion and the X-ray absorbing liquid. The local quantity of liquid is to be understood to mean herein the quantity of liquid locally present in a comparatively small volume of the X-ray filter.

As more X-ray absorbing liquid is present in a given part of the X-ray filter, more X-ray absorption will occur in that part. The gaps between individual conductive parts of respective plates constitute filter elements whose X-ray absorptivity can be controlled on the basis of the applied electric voltage. The X-ray absorbing liquid used is preferably a lead salt solution in water.

If the X-ray absorbing liquid flows in between or from two of the parallel plates, only a slight flow pressure drop occurs, in other words the friction experienced by the X-ray absorbing liquid is less in comparison with the flow pressure drop which would occur if the X-ray absorbing liquid were to flow into or out of a capillary tube as in the known X-ray filter. Consequently, the liquid can be applied between or removed from between two of the parallel plates so fast that the adjustment of the X-ray filter requires less time than in the known X-ray filter. It has been found that the switching time amounts to only a fraction of a second.

The thinner the parallel plates, the less background absorption of X-rays will occur. The background absorption will be lower than that in a known X-ray filter of the same dimensions. The electrically conductive portions can be readily provided on the parallel plates in a desired pattern. Furthermore, the x-ray filter of the x-ray examination apparatus accordng to the invention has a very simple construction and therefore can be easily manifactured.

A preferred embodiment of an X-ray examination apparatus according to the invention is characterized in that the electrically conductive portions are formed by electrically conductive tracks.

The parallel plates and the electrically conductive tracks are preferably arranged approximately parallel to the direction of the X-ray beam. The local X-ray absorptivity is dependent on the local quantity of X-ray absorbing liquid between the parallel plates. If the electric voltage is applied to a relevant electrically conductive track, the X-ray absorbing liquid rises between the parallel plates in a region near the relevant track. Herein, rising is to be understood to mean not only movement of the liquid in the vertical direction, but more generally the movement of the X-ray absorbing liquid between the plates in the direction away from the reservoir. As the tracks are longer, a greater rise can be achieved, enabling a large variation of the local X-ray absorptivity.

Preferably, the tracks have a width of approximately 50 $\mu$m and the clearance between two tracks on the same plate amounts to approximately 5 $\mu$m. For these dimensions considerable intensity differences can be achieved over small distances of a few millimeters within the cross-section of the X-ray beam; individual tracks can then still be suitably excited by means of the electric voltage, independently of one another.

A further preferred embodiment of an X-ray examination apparatus according to the invention is characterized in that the electrically conductive portions or tracks are provided on both sides of the parallel plates.

Within short distances in the X-ray filter, substantial variations can locally be achieved in the rise height of the X-ray absorbing liquid, and hence in the X-ray absorptivity. Rise heights of from a few centimeters to as much as 5 cm are feasible.

A further preferred embodiment of an X-ray examination apparatus according to the invention is characterized in that the parallel plates are constructed as glass foil plates or polymer foil plates.

Glass foil can be readily worked and it has been found that conductive portions or tracks can be readily provided thereon. Furthermore, glass foil is very thin, for example a few tens of micrometers, so that the background absorption of the X-ray filter remains low. In addition to glass foil, polymer foils such as a polyethylene or polypropylene foils are also suitable.

A further preferred embodiment of an X-ray examination apparatus according to the invention is characterized in that the electrically conductive portions or tracks are covered by a dielectric layer.

The dielectric layer ensures that the electric capacitance between the X-ray absorbing liquid and the electrically conductive portions or tracks is sufficiently small so as to enable a fast X-ray filter response. The dielectric layer is preferably impermeable to the X-ray absorbing liquid, thus counteracting breakdowns between the electrically conductive portions and the X-ray absorbing liquid. The dielectric layer, however, can be covered by a sealing layer so as to avoid electrical breakdown. Preferably, the dielectric layer is a polyimide layer. But also polymen like parylene and polystyrene are quite nutable materials for the dielectric layer. In addition, metalonides such as aluminium or tantolumonide can be used for forming the dielectric layer.

A further preferred embodiment of an X-ray examination apparatus according to the invention is characterized in that the dielectric layer is covered by a hydrophobic coating layer.

Such a hydrophobic coating layer ensures that the contact angle between the X-ray absorbing liquid and the coating layer is substantially larger than 90° if no electric voltage is applied to the relevant electrically conductive portion or track. Depending on the materials used for the X-ray absorbing liquid and the wall of the filter elements, in that case either no electric potential difference exists between the electrically conductive portions and the X-ray absorbing liquid or possibly a residual electric potential difference prevails due to an electrically charged double layer between the wall of the filter element and the X-ray absorbing liquid. The applied electric voltage changes the electric potential difference between the electrically conductive portion and the X-ray absorbing liquid. Application or variation of an electric voltage reduces the contact angle; in the case of a sufficiently high electric voltage value, the contact angle is reduced to less than 90°, the filter then being at least partly filled with the X-ray absorbing liquid in the vicinity of the relevant electrically conductive portion or track. By choosing a hydrophobic coating layer, it is achieved that the X-ray filter is not filled with the X-ray absorbing liquid in areas where no electric voltage is applied to the relevant electrically conductive portion or track. By applying an electric voltage to such an electrically conductive portion or track, the contact angle is varied to less than 90°, so that the hydrophoby is eliminated. If no electric voltage is applied to an electrically conductive portion or track, the electrically conductive portion or track has hardly any X-ray absorptivity. By choosing the coating layer to be hydrophobic, it is achieved that hardly any or no unintended residual X-ray absorbing liquid remains in the electrically conductive portions or tracks if no electric voltage is applied to the relevant electrically conductive portions or tracks. Consequently, it is not necessary to take special steps to ensure that, if desired, the X-ray filter is drained in the vicinity of the relevant electrically conductive portions or tracks. Undesirable (background) X-ray absorption by the filter is thus simply counteracted.

A further preferred embodiment of an X-ray examination apparatus according to the invention is characterized in that the X-ray filter is provided with a heating device for heating the X-ray absorbing liquid.

Heating the X-ray absorbing liquid reduces the viscosity and the liquid can then more readily flow between the parallel plates upon variation of the electric voltage. The X-ray absorbing liquid can be heated quite simply by heating the entire X-ray filter. For example, when heated to approximately 60° C., the viscosity of the X-ray absorbing liquid is halved in comparison with its viscosity at 20° C.

BRIEF DESCRIPTION OF THE DRAWING

These and other aspects of the invention will be described in detail hereinafter with reference to the following embodiments and the accompanying drawing; therein

DETAILED DESCRIPTION OF THE PREFERRED EMBODIMENTS

Figure 1:
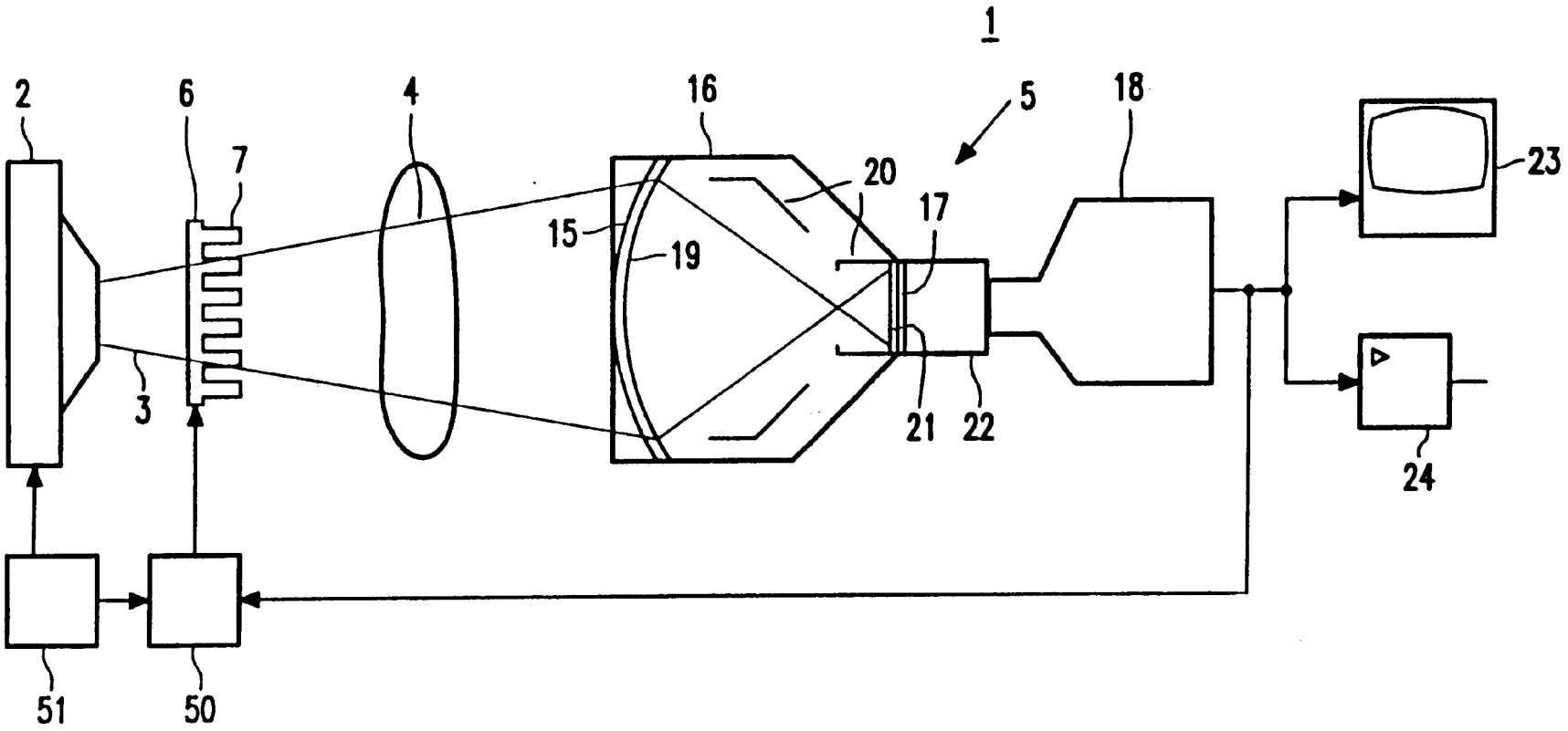
FIG. 1 shows diagrammatically an X-ray examination apparatus 1 according to the invention.

FIG. 1 shows diagrammatically an X-ray examination apparatus 1 according to the invention. The X-ray source 2 emits an X-ray beam 3 for irradiating an object 4. Due to differences in the X-ray absorption within the object 4, for example a patient to be radiologically examined, an X-ray image is formed on an X-ray-sensitive surface 15 of the X-ray detector 5 which is arranged so as to face the X-ray source. A high-voltage power supply 51 supplies the X-ray source 2 with an electric high voltage. The X-ray detector 5 of the present embodiment is an image intensifier pick-up chain which includes an X-ray image intensifier 16 for converting the X-ray image into an optical image on an exit window 17, and a video camera 18 for picking up the optical image. The entrance screen 19 acts as the X-ray-sensitive surface of the X-ray image intensifier which converts incident X-rays into an electron beam which is imaged on the exit window by means of an electron-optical system 20. The incident electrons generate the optical image on a phosphor layer 21 of the exit window 17. The video camera 18 is coupled to the X-ray image intensifier 16 by way of an optical coupling 22, for example a system of lenses or an optical fiber coupling. The video camera 18 derives an electronic image signal from the optical image, which image signal is applied to a monitor 23 so as to visualize the image information contained in the X-ray image. The electronic image signal can also be applied to an image processing unit 24 for further processing.

The X-ray filter 6 is arranged between the X-ray source 2 and the object 4 in order to attenuate the X-ray beam locally. The X-ray absorptivity of individual filter elements 7 of the X-ray filter 6 is adjusted by means of an adjusting unit 50. The adjusting unit 50 is coupled to the high-voltage supply 51, so that the X-ray filter 6 can be adjusted on the basis of the intensity of the X-ray beam 3 emitted by the X-ray source.

Figure 2:
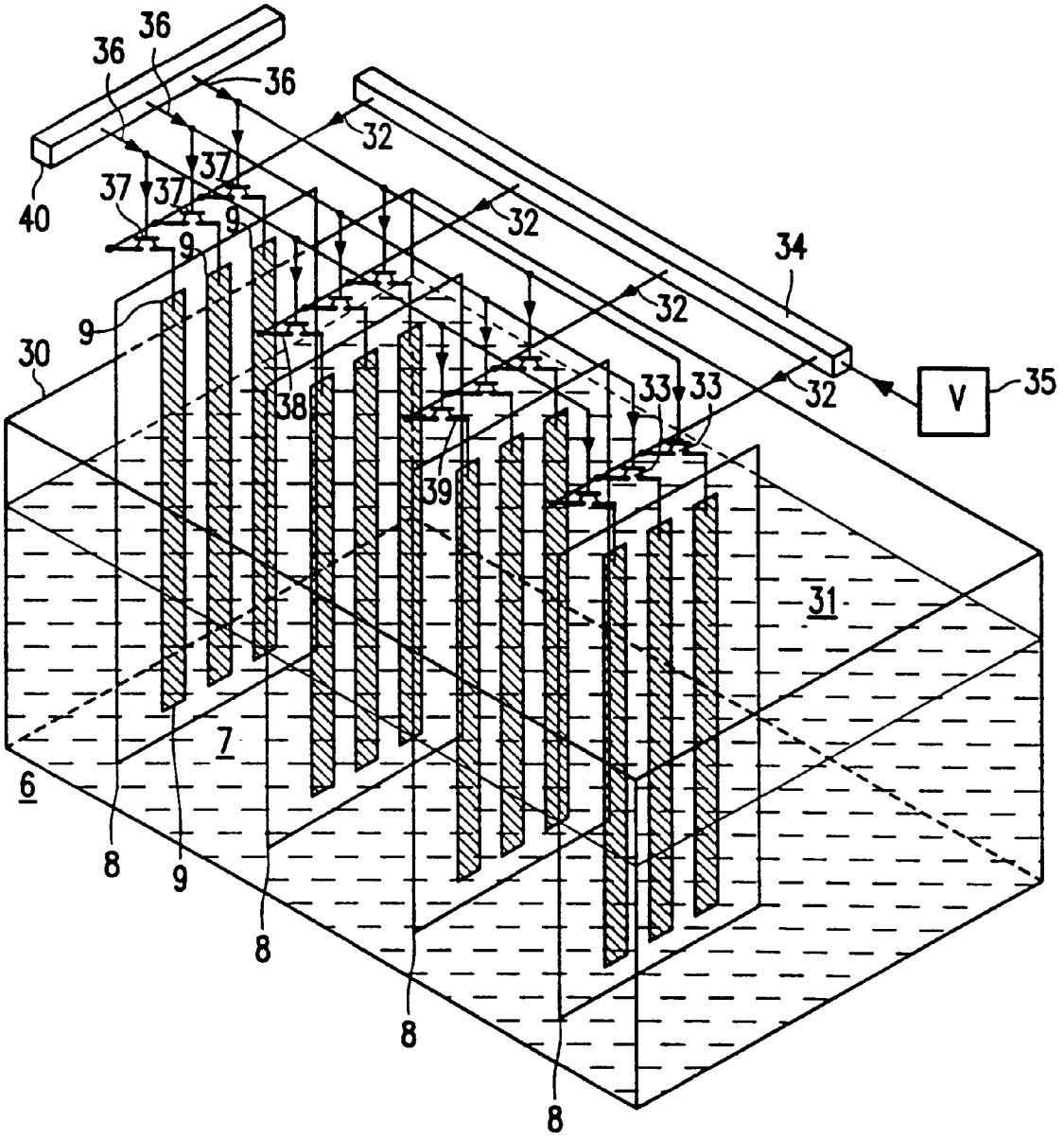
FIG. 2 shows diagrammatically an X-ray filter of an X-ray examination apparatus according to the invention.

FIG. 2 shows diagrammatically an X-ray filter of an X-ray examination apparatus according to the invention. The X-ray filter includes a number of substantially parallel plates provided with electrically conductive portions 9, for example electrically conductive tracks. For the sake of simplicity, the drawing shows only four plates 8, each of which is provided with three electrically conductive tracks. In practice, however, use is made of a large number of parallel plates, for example from some tens to some hundreds of plates, each of which is provided with from tens to hundreds of electrically conductive tracks. The X-ray filter has, for example lateral dimensions (relative to the direction of the X-ray beam) of approximately 0.5 cm+0.5 cm. The spacing between neighboring plates is approximately 0.3 mm. Gaps between electrically conductive tracks 9 of respective plates 8 constitute individual filter elements 7 which communicate with a reservoir 30 of an X-ray absorbing liquid 31. A suitable X-ray absorbing liquid is, for example a solution of lead salt such as lead perchlorate ($Pb(ClO_4)_2$) in demineralized water. Due to the capillary effect in the individual filter elements, the X-ray absorbing liquid rises in the individual filter elements in dependence on the electric voltage applied to the relevant electrically conductive tracks. The capillary effect is due to adhesion between the X-ray absorbing liquid and parts of the plates constituting walls of the individual filter elements. Such adhesion can be controlled on the basis of the electric voltage applied to the electrically conductive tracks. In the vicinity of an electrically conductive track 9 whereto no electric voltage is applied, meaning that no or hardly any electric voltage difference exists between the electrically conductive track and the X-ray absorbing liquid, the relevant plate 8 is hydrophobic to the X-ray absorbing liquid. Wherever an electric voltage is applied to the electrically conductive tracks, the hydrophobicity is canceled and even converted into hydrophility, so that gaps between relevant electrically conductive tracks are filled with the X-ray absorbing liquid. The degree of filling of such gaps with the X-ray absorbing liquid can be controlled on the basis of the electric voltage applied to the relevant electrically conductive tracks. It has been found that the adjustment of the X-ray filter can thus be changed within approximately 0.1 s.

The electric voltages are applied to the electrically conductive portions 9 via voltage leads 32. Individual voltage leads 32 are provided for individual plates 8. The electrically conductive portions are electrically connected to the relevant voltage lead via respective switches 33. α-Si thin-film MOS transistors are particularly suitable for use as switches for controlling the X-ray filter. The voltage leads 32 are connected to an electric voltage source 35 via a column driver 34. The column driver 34 provides the distribution of desired electric voltages between the electrically conductive portions 9 of individual plates 8.

For control of the thin-film transistors 33 control leads 36 are provided per row of electrically conductive portions 9 of individual plates 8, which control leads are electrically coupled to the respective gate contacts 37 of the thin-film transistors 33. The source contact 38 of each thin-film transistor 33 is coupled to the relevant voltage lead 32, their drain contact 39 being coupled to the relevant electrically conductive track 9. The respective thin-film transistors 33 are closed, i.e. made electrically conductive, by applying a control signal to the relevant control lead. The control signals are supplied by a row driver 40. The relevant electrically conductive track is adjusted to the desired electric voltage by closing a relevant thin-film transistor 33 by means of a control signal and at the same time supplying an appropriate voltage via the corresponding control lead. Consequently, the hydrophobicity of the plate 8 is canceled in the vicinity of the relevant electrically conductive track and the volume in the vicinity of the electrically conductive track is filled with the X-ray absorbing liquid. The degree of filling is dependent on the applied electric voltage. The row driver 40, the column driver 34 and the electric voltage source 35 form part of the adjusting unit 50.

Figure 3:
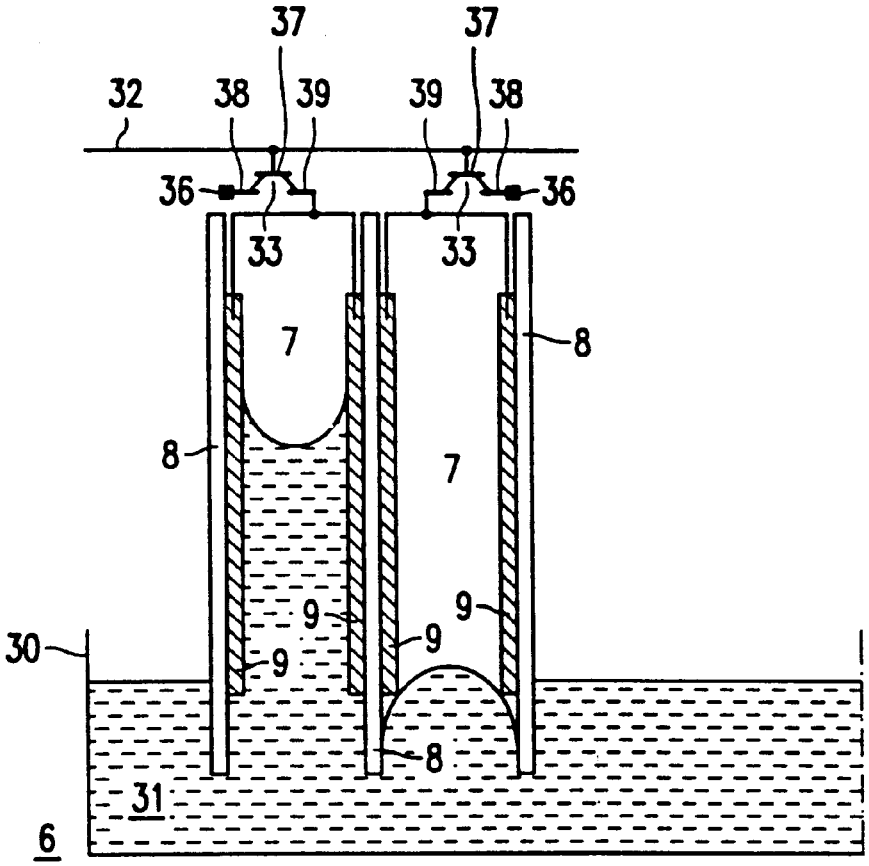
FIG. 3 shows diagrammatically a detail with some filter elements of an X-ray filter of an X-ray examination apparatus according to the invention.

FIG. 3 is a diagrammatic representation of a detail with some filter elements of an X-ray filter of an X-ray examination apparatus according to the invention. FIG. 3 notably shows three of a larger number of plates 8 of the X-ray filter in a side elevation; therein, gaps between two adjacent plates constitute individual filter elements 7. In the situation shown, an electric voltage is applied to electrically conductive tracks 9 on the walls of the left-hand filter element in the Figure, so that the left-hand filter element is filled with an X-ray absorbing liquid to a considerable extent. No electric voltage is applied to the electrically conductive tracks 9 on the walls of the right-hand filter element, so that no electric potential difference exists between the relevant electrically conductive tracks and the X-ray absorbing liquid; therefore, the walls of the right-hand filter element are hydrophobic to the X-ray absorbing liquid. Consequently, the X-ray absorbing liquid does not or hardly flows into the intermediate space constituting the right-hand filter element.

Figure 4:
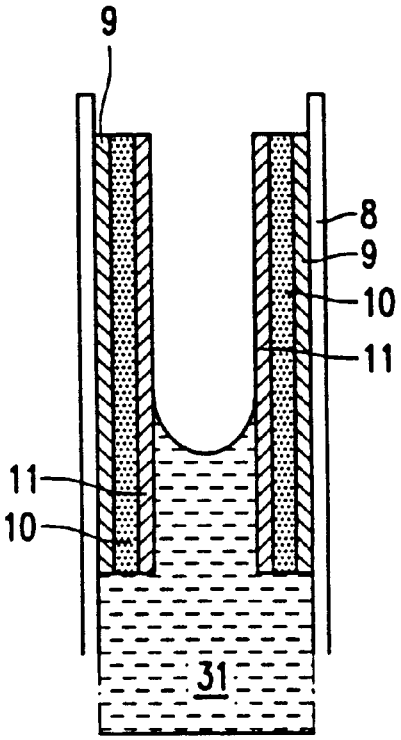
FIG. 4 shows a detail of a filter element of an X-ray filter of an X-ray examination apparatus according to the invention.

FIG. 4 shows a detail of a filter element of an X-ray filter of an X-ray examination apparatus according to the invention. The filter element is formed by the space between two parallel plates 8 on which electrically conductive tracks 9 are provided. The plates preferably consist of electrically non-conductive glass foil plates 8. Such glass foil plates have a thickness of approximately 30 $\mu$m. Electrically conductive tracks are provided on the plates 8. Most conductive materials which suitably adhere to the glass foil are suitable for this purpose. For example, gold, titanium nitrite or indium-tin oxide can be used to form the tracks. Such tracks can be realized by means of a sputtering process or by chemical vapor deposition. On the electrically conductive tracks there is provided a dielectric layer 10 which counteracts electric breakdowns between the X-ray absorbing liquid and the electrically conductive tracks. The tracks have a width of approximately 300 $\mu$m, so that electric contact can be readily established between the tracks and the transistors. The dielectric layer is, for example a poly-imide layer, a parylene layer or a layer of an electrophoretic lacquer. Notably silicon nitrite and silicon dioxide layers of a thickness of several tens of nm are also suitable dielectric layers. The dielectric layer is completely or extensively coated by a hydrophobic coating layer 11 of, for example polydimethyl siloxane. It is also possible to provide a polyfluorohydrocarbon hydrophobic coating layer 11 directly on the electrically conductive layer.

Figure 5:
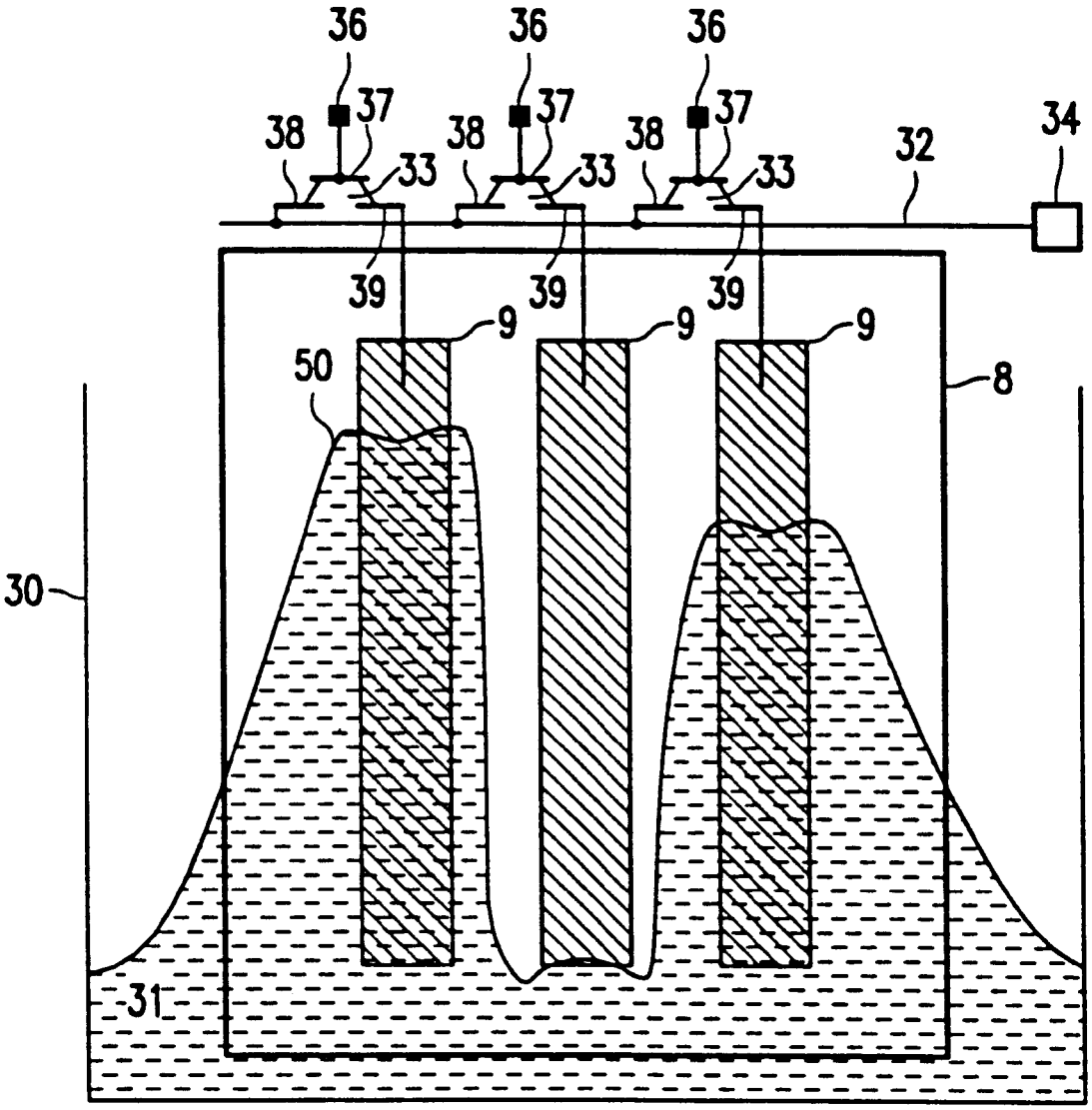
FIG. 5 shows diagrammatically a detail with some filter elements of the X-ray filter in a side elevation taken transversely of the plates.

FIG. 5 shows diagrammatically a detail with some filter elements of the X-ray filter shown in a side elevation taken transversely of the plates. In FIG. 5 notably one of the plates 8 is visible on which electrically conductive tracks 9 have been provided. For the sake of simplicity the Figure shows only three electrically conductive tracks, but in practice there may be as many as from 100 to 200 electrically conductive tracks on each plate. In the situation shown in FIG. 5, no electric voltage is applied to the electrically conductive track at the centre and an electric potential difference exists between the X-ray absorbing liquid 31 and the outer electrically conductive tracks 9. Because of this electric potential distribution, the hydrophobicity of the outer electrically conductive tracks 9 is substantially canceled and, depending on the value of the applied electric voltage, the level of the X-ray absorbing liquid rises in the vicinity of the outer electrically conductive tracks and the level of the X-ray absorbing liquid remains low in the vicinity of the central electrically conductive track 9. The spatial distribution of the level of the X-ray absorbing liquid in the filter is thus adjusted by application of suitable electric voltages to individual electric tracks. The amount of X-ray absorbing liquid in the individual filter elements is thus controlled by way of the applied electric voltages.

We claim:

1. An X-ray examination apparatus including an X-ray source, an X-ray detector for picking up the X-ray image, and an X-ray filter which is arranged between the X-ray source and the X-ray detector, the X-ray absorptivity of the X-ray filter being locally adjustable by control of a local quantity of an X-ray absorbing liquid in the X-ray filter, characterized in that the X-ray filter is provided with substantially parallel plates with electrically conductive portions, and that a quantity of X-ray absorbing liquid between respective parallel plates can be controlled.

2. An X-ray examination apparatus as claimed in claim 1, characterized in that the electrically conductive portions are formed by electrically conductive tracks.

3. An X-ray examination apparatus as claimed in claim 1, characterized in that the electrically conductive portions or tracks are provided on both sides of the parallel plates.

4. An X-ray examination apparatus as claimed in claim 1, characterized in that the parallel plates are constructed as glass foil plates or polymer foil plates.

5. An X-ray examination apparatus as claimed in claim 1, characterized in that the electrically conductive portions or tracks are covered by a dielectric layer.

6. An X-ray examination apparatus as claimed in claim 5, characterized in that the dielectric layer is covered by a hydrophobic coating layer.

7. An X-ray examination apparatus as claimed in claim 1, characterized in that the X-ray filter is provided with a heating device for heating the X-ray absorbing liquid.

8. An X-ray examination apparatus as claimed in claim 2, characterized in that the electrically conductive portions or tracks are provided on both sides of the parallel plates.

9. An X-ray examination apparatus as claimed in claim 2, characterized in that the parallel plates are constructed as glass foil plates or polymer foil plates.

10. An X-ray examination apparatus as claimed in claim 3, characterized in that the parallel plates are constructed as glass foil plates or polymer foil plates.

11. An X-ray examination apparatus as claimed in claim 8, characterized in that the parallel plates are constructed as glass foil plates or polymer foil plates.

12. An X-ray examination apparatus as claimed in claim 2, characterized in that the electrically conductive portions or tracks are covered by a dielectric layer.

13. An X-ray examination apparatus as claimed in claim 3, characterized in that the electrically conductive portions or tracks are covered by a dielectric layer.

14. An X-ray examination apparatus as claimed in claim 4, characterized in that the electrically conductive portions or tracks are covered by a dielectric layer.

15. An X-ray examination apparatus as claimed in claim 8, characterized in that the electrically conductive portions or tracks are covered by a dielectric layer.

16. An X-ray examination apparatus as claimed in claim 9, characterized in that the electrically conductive portions or tracks are covered by a dielectric layer.

17. An X-ray examination apparatus as claimed in claim 10, characterized in that the electrically conductive portions or tracks are covered by a dielectric layer.

18. An X-ray examination apparatus as claimed in claim 11, characterized in that the electrically conductive portions or tracks are covered by a dielectric layer.

19. An X-ray examination apparatus as claimed in claim 12, characterized in that the dielectric layer is covered by a hydrophobic coating layer.

20. An X-ray examination apparatus as claimed in claim 13, characterized in that the dielectric layer is covered by a hydrophobic coating layer.

* * * * *